US006254645B1

(12) United States Patent
Kellis, Jr. et al.

(10) Patent No.: US 6,254,645 B1
(45) Date of Patent: Jul. 3, 2001

(54) ENZYMATIC MODIFICATION OF THE SURFACE OF A POLYESTER FIBER OR ARTICLE

(75) Inventors: James T. Kellis, Jr., Portola Valley; Ayrookaran J. Poulose, Belmont; Mee-Young Yoon, Palo Alto, all of CA (US)

(73) Assignee: Genencor International, Inc., Rochester, NY (US)

( * ) Notice: Subject to any disclaimer, the term of this patent is extended or adjusted under 35 U.S.C. 154(b) by 0 days.

(21) Appl. No.: 09/435,083

(22) Filed: Nov. 5, 1999

Related U.S. Application Data

(63) Continuation-in-part of application No. 09/378,087, filed on Aug. 20, 1999, now abandoned.

(51) Int. Cl.[7] ..... C09B 67/00; D06M 1/02; C12S 11/00

(52) U.S. Cl. ..... 8/401; 8/115.51; 8/115.54; 8/DIG. 4

(58) Field of Search ..... 510/392, 393, 510/394, 530; 8/115.51, 115.54, 401, DIG. 4

(56) References Cited

U.S. PATENT DOCUMENTS

| | | | | |
|---|---|---|---|---|
| 3,018,272 | | 1/1962 | Griffing et al. . | |
| 3,057,827 | | 10/1962 | Griffing et al. . | |
| 3,381,058 | | 4/1968 | Caldwell et al. . | |
| 3,950,277 | | 4/1976 | Stewart et al. . | |
| 4,569,974 | * | 2/1986 | Gillberg-LaForce | 525/437 |
| 4,810,414 | * | 3/1989 | Huge-Jensen et al. | 252/174.12 |
| 4,876,024 | | 10/1989 | Enomoto et al. . | |
| 5,069,846 | * | 12/1991 | Grindstaff et al. | 264/103 |
| 5,069,847 | * | 12/1991 | Grindstaff | 264/103 |
| 5,512,203 | | 4/1996 | Kolattukudy et al. . | |
| 5,578,489 | | 11/1996 | Petersen . | |
| 5,733,750 | | 3/1998 | Lund et al. . | |

FOREIGN PATENT DOCUMENTS

| | | | |
|---|---|---|---|
| 0 214 761 A2 | | 8/1986 | (EP) . |
| 0 476 915 A2 | | 9/1990 | (EP) . |
| 052082774 | | 7/1977 | (JP) . |
| 05344897 | | 12/1993 | (JP) . |
| WO 88/09367 | * | 12/1988 | (WO) . |
| WO 90/09446 | | 8/1990 | (WO) . |
| WO 93/13256 | * | 7/1993 | (WO) . |
| WO 97/27237 | | 7/1997 | (WO) . |
| WO 97/33001 | | 9/1997 | (WO) . |
| WO 99/01604 | | 1/1999 | (WO) . |
| WO 00/34450 | | 6/2000 | (WO) . |

OTHER PUBLICATIONS

"CMC: Calculation of Small Color Differences for Acceptability," *AATCC Technical Manual*, vol. 66, pp. 321–326 (1991).

Duff et al., "Practical Considerations," *Gile's Laboratory course in dyeing*, 4th Ed., pp. 7–14.

"Innovative weight reduction technique," *International Dyer*, pp. 20–24 (1999).

Hansen et al., "Polyester," *Encyclopedia of Chemical Technology*, 4th Ed., vol. 10, pp. 662–685 (1993).

"Proteolytic Enzymes: Serine and Cysteine Peptidases," *Methods in Enzymology*, Academic Press, V. 244, pp. 193–223.

McIntyre, "Polyester Fibers," *Handbook of Fiber Science & Technology*, vol. 4, pp. 1–71 (1985).

Sato, "Deterioration of Polyurethane Filaments with Fungal Enzymes, *Aspergillus niger FERM J–1* and *Cladosporium cladosporioides FERM J–8*," *Sen–I Gakkaishi*, vol. 37, No. 7, pp. 80–90 (1981).

Sato, "Deterioration of Filaments and Films of Polyethyleneterephthalate with Enzyme of *Cladosporium cladosporioides* FERM J–8," *Sen–I Gakkaishi*, vol. 39, No. 5, pp. 67–77 (1983).

Taylor, Bruce, "Polyester into the Next Millenium," *Textile Outlook International*, Jul. 1999, pp. 129–147.

Teli et al., "Effect Of Fabric Geometry On Alkaline Hydrolysis Of Polyester: Part 1," *American Dyestuff Reporter*, pp. 28–33 (1992).

Vigo, Tyrone L., "Fabrics with Improved Aesthetic and Functional Properties," *Textile Processing and Properties—Preparation, Dyeing, Finishing and Performance*, 1st Ed., (1994).

Yang et al., "Ethylene Glycol and Glycerin as the Solvent for Alkaline Treatment of Poly(ethylene Teraphthalate) Fabrics," *Textile Research Journal*, vol. 67, pp. 760–766 (1997).

Zahn et al., "The Impact of Natural Fiber Science on Manmade Fiber Technology," *Textile Research Journal*, vol. 43, pp. 601–606 (1973).

PCT Search Report.

(List continued on next page.)

*Primary Examiner*—Yogendra N. Gupta
*Assistant Examiner*—John M Petruncio
(74) *Attorney, Agent, or Firm*—Christopher L. Stone

(57) ABSTRACT

A method is provided for improving the uptake of a cationic compound onto a polyester article starting material, comprising the steps of: (a) obtaining a polyesterase enzyme; (b) contacting said polyesterase enzyme with said polyester article starting material under conditions and for a time suitable for said polyesterase to produce surface modification of said polyester article starting material and produce a surface modified polyester; (c) contacting said modified polyester article, subsequently or simultaneously with said step (b) with a cationic compound whereby adherence of said cationic compound to said modified polyester is increased compared to said polyester starting material. Also disclosed is a method for increasing the hydrophilicity of a polyester to improve fabric characteristics such as stain resistance, wettability and/or dyeability.

15 Claims, 2 Drawing Sheets

OTHER PUBLICATIONS

Cimecioglu et al., "Properties of Oligomers Present in Poly(ethylene Terephthalate)," *J. of Applied Polymer Science*, V. 32, 4719–4733 (1986).

Derminot et al., "Oligomers of Polyester," *Bull. Sci. Inst. Text. Fr.*, V. 5, N. 19, pp. 215–229, (Aug. 1976) English Translation.

"Means of Analyzing Oligomers in Polyester Textiles and Practical Applications," *Industrie Textile*, No. 1083, pp. 677–681 (Nov. 1978) ITT Translation No. 1769C17P.

Webb, "Recommendations of the Nomenclature Committee of the International Union of Biochemistry and Molecular Biology on the Nomenclature and Classification of Enzymes," *Enzyme Nomenclature*, pp. 306–315, 1992.

Wick et al., "Cyclic Oligomers in Polyesters Made From Diols and Aromatic Dicarboxylic Acids," *Angewandte Makromolekulare Chemie*, V. 112, N. 1771, pp. 59–94 (1983) English Translation.

* cited by examiner

ENZYMATIC MODIFICATION OF THE SURFACE OF A POLYESTER FIBER OR ARTICLE

Related APPLICATION

This application is a continuation-in-part of U.S. patent application Ser. No. 09/378,087 filed Aug. 20, 1999, all of which is hereby incorporated herein in its entirety now abandoned.

BACKGROUND OF THE INVENTION

A. Field of the Invention

The present invention relates to the field of the modification of synthetic fibers used in the production of yarns used for the production of fabrics, textiles, rugs and other consumer items. More specifically, the present invention relates to the enzymatic modification of the characteristics of a polyester fiber so that such polyesters are more susceptible to post-modification treatments.

B. State of the Art

Polyesters are manufactured synthetic compositions comprising any long chain synthetic polymer composed of at least 85% by weight of an ester of a substituted aromatic carboxylic acid, including but not restricted to substituted terephthalic units and parasubstituted hydroxybenzoate units. The polyester may take the form of a fiber, yarn, fabric, film, resin or powder. Many chemical derivatives have been developed, for example, polyethylene terephthalate (PET), polytrimethylene terephthalate (PTT), polybutylene terephthalate (PBT) and polyethtlene naphthalate (PEN). However, PET is the most common linear polymer produced and accounts for a majority of the polyester applied in industry today.

Thermoplastic polyester can be selectively engineered in any of the basic processing steps of polymerization and fiber formation. This flexibility and range of properties allows for a wide range of products to be made from polyester for markets such as the apparel, home furnishing, upholstery, film, rigid and flexible container, non-woven fabric, tire and carpet industries. As a result, polyester has become the dominant reinforcement fiber in the United States. Moreover, while over the past 30 years cotton has continued slow, steady growth of volume consumed and wool has been virtually flat, polyester has begun to take on increased significance. Moreover, polyester has reached a high level of consumer acceptance due to its strength and the increasing quality and variety of fabrics that can be made using such fibers. Other polyester markets such as fiber-fill and non-woven articles continue to grow.

In the textile industry, polyester has certain key advantages including high strength, soft hand, stretch resistance, stain resistance, machine washability, wrinkle resistance and abrasion resistance. However, polyester is not so optimal in terms of its hydrophobicity, pilling, static, dyeability, inactive surface as a medium for adhering, i.e., softening or wettability enhancing compounds, and lack of breathability. Moreover, in the 1960's and 1970's, polyester textiles suffered from poor consumer perception and was synonymous with the phrase "cheaply made" and derided for the horrendous colors with which polyester was associated. This latter problem is due in large part to the unavailability of a large selection of dyes which are compatible with polyester. To combat this perception, the industry has made strong efforts to improve the characteristics of polyester.

One of the problem areas that the industry has sought to improve involves the characteristic that polyester is very resistant to uptake of polar or charged compositions, i.e., fabric softeners, finishes and dyes. In the past, many synthetic fibers such as those of cellulose acetate, cellulose triacetate, acrylonitrile, polyesters, polyamides and polyhydrocarbon polymers were thought not to be satisfactorily dyed with basic dyes nor with cotton dyes. Current methods for dyeing polyester include replacing chemical substitution of terephthalate with compounds such as isophthalate and sulfo-isophthalate which improve the uptake of the dye, improving chemical penetration of the dyes by using high temperature, emulsified aromatic and/or chlorinated aromatic solvents, adding colorant to the molten polyester, and the use of cross-linking polymers to glue the pigment to the fabric. U.S. Pat. No. 3,381,058 discloses a method of making a poly(1,4-cyclohexylenedimethylene terephthalate) fiber having non-fiber forming polyester dispersed therein for the purpose of improving dyeability. Similar objects are achieved by methods described in U.S. Pat. No. 3,057,827 (preparing a high molecular weight linear condensation copolyester from linear polyester forming compounds with an essential component of a sulfinite radical) and U.S. Pat. No. 3,018,272 (preparing compounds comprising a polyester using a metallic salt of a sulfonate).

Another problem with polyester relates to the difficulty of removing oily and/or hydrophobic stains. These stains often adhere strongly to the fabric or fiber and cause a permanent stain.

Thus, methods for improving the surface characteristics of polyester have been developed in an attempt to improve the dyeing, stain resistance and other properties associated with the strongly hydrophobic nature of the polyester. For example, chemical methods such as nucleophilic substitution via nucleophile attack at the ester carbonyl or hydrolysis; surface polymerization by crosslinking a topical finish to either the fiber or the fabric; chemical penetration of the polyester polymer with aromatic compounds; and topical application of a surface coating from an aqueous solution which has affinity for the polyester. Nonetheless, these processes often have inherent deficiencies such as cost of chemicals, energy and capital equipment, the use of environmentally unsafe solvents, limited flexibility and negative effects on strength of the material and other aesthetic properties of the fabrics.

GB 2296011 A discloses enzymes naturally produced by a fungus of the species Fusarium solanii var. minus T.92.637/1, including a cutinase of isoelectric point 7.2 and mol. wt. 22 kDa. which are useful in detergent compositions for removing fatty acid-based dirt and stains.

U.S. Pat. No. 5,512,203 discloses cleaning compositions comprising a cutinase enzyme and a polyesterase compatible surfactant. The microbial cutinase is from *Pseudomonas mendocina* and is used in an improved method for enzymatically cleaning a material having a cutin or cutin-like stain.

PCT Publication No. WO 97/43014 (Bayer AG) describes the enzymatic degradation of polyesteramide by treatment with an aqueous solution comprising an esterase, lipase or protease.

JP 5344897 A (Amano Pharmaceutical KK) describes a commercial lipase composition which is dissolved in solution with an aliphatic polyester with the result that the fiber texture is improved without losing strength. Polymers of aliphatic polyethylene are also disclosed which can be degraded by lipase from Pseudomonas spp.

PCT Publication No. 97/33001 (Genencor International, Inc.) discloses a method for improving the wettability and absorbance of a polyester fabric by treating with a lipase.

PCT Publication No. WO 99/01604 (Novo Nordisk) describes a method for depilling a polyester fiber or fabric and for color clarification of such fabrics by reacting with an enzyme which has either ethyleneglycol dibenzyl ester (BEB) and/or terephthalic acid diethyl ester (ETE) hydrolytic activity.

While advances have been achieved in the field of improving the quality of polyester, the industry remains in need of additional methods of producing polyesters with improved characteristics.

SUMMARY OF THE INVENTION

It is an object of the present invention to provide for a method of modifying the surface properties of a polyester fiber or article to enable improved subsequent modification thereof.

It is a further object of the invention to provide for a method of modifying the surface properties of a polyester fiber or article such that the fiber or article has improved characteristics with respect to uptake of cationic compounds.

It is yet a further object of the invention to provide for a polyester fiber or article having improved ability to uptake a dye.

It is yet a further object of the invention to provide for a method of producing a polyester fiber having improved performance characteristics such as, dyeability, chemical modification and/or fabric finishing.

It is yet another object of the invention to provide for a method of treating a polyester enzymatically, wherein the polyester is subsequently treated with organic acids so as to further increase the hydrophilicity and/or charge of the surface and thereby improve the uptake of cationic compounds and/or the stain resistance of the fabric.

It is yet another object of the invention to provide for a method of treating a polyester enzymatically, wherein the polyester is capable of reacting and forming bonds to a greater extent with chemicals which will react and form bonds with alcohols and carboxylic acids.

According to the present invention, a method is provided for modifying the surface of a polyester article comprising treating said polyester article with an enzyme having polyesterase activity for a time and under conditions such that the chemical properties of the surface are modified to produce a surface modified polyester. Preferably, the surface modified polyester article obtained is subjected to further treatment, the benefit of which treatment has been improved by the enzymatic surface modification. In one preferred embodiment, the enzymatically surface modified polyester article is reacted with a chemical reagent to form a non-covalent interaction between the surface of the polyester and the reagent. In another preferred embodiment, the enzymatically surface modified polyester is reacted with a chemical reagent to form a covalent bond between the polyester and the reagent or another compound. In this embodiment, it is possible to enzymatically form such a bond.

A preferred covalent interaction between the chemical reagent and the surface modified polyester of the invention comprises treating the polyester with a chemical resulting in a further increase in hydrophilic groups on the surface of the composition. Another preferred covalent interaction comprises further derivatizing chemically or enzymatically the surface of a polyester with a reagent which carries a desired functionality, for example, color or dye, antimicrobial, antiperspirant, deodorant, anti-stain or fabric finishing activity. An especially preferred covalent interaction comprises treating the surface modified polyester article with a dye to form a dye-polyester covalent bond.

A preferred non-covalent interaction between the chemical reagent and the surface modified polyester of the invention comprises treating the polyester with a dye which forms a non-covalent bond with the polyester. Other preferred non-covalent interactions comprise treating the surface of the surface modified polyester with a reagent which carries a desired functionality, for example, color or dye, anti-staining, antimicrobial, antiperspirant, deodorant or fabric finishing activity.

In a method embodiment of the invention, a method for improving the uptake of a cationic compound onto a polyester article starting material is provided comprising the steps of obtaining a polyesterase enzyme; contacting said polyesterase enzyme with the polyester article starting material under conditions and for a time suitable for the polyesterase to produce surface modification of the polyester article starting material and produce a surface modified polyester; and contacting the modified polyester article, subsequently or simultaneously with the enzymatic treatment step, with a cationic compound whereby adherence of the cationic compound to the modified polyester is increased compared to the polyester starting material. Preferably, the polyesterase is contacted with the polyester article in conjunction with a surfactant.

In a method embodiment of the invention, a polyester article is produced according to the method of the invention. Preferably, the polyester article has improved dye uptake, antimicrobial activity, resistance to stains, antiperspirant, deodorant, finishing, hydrophilicity, wettability, and/or ability to uptake other cationic compounds compared to the same polyester except for not being enzymatically treated. In a most preferred embodiment, the polyester article is dyed with a cationic dye.

DETAILED DESCRIPTION OF THE INVENTION

Figure 1:
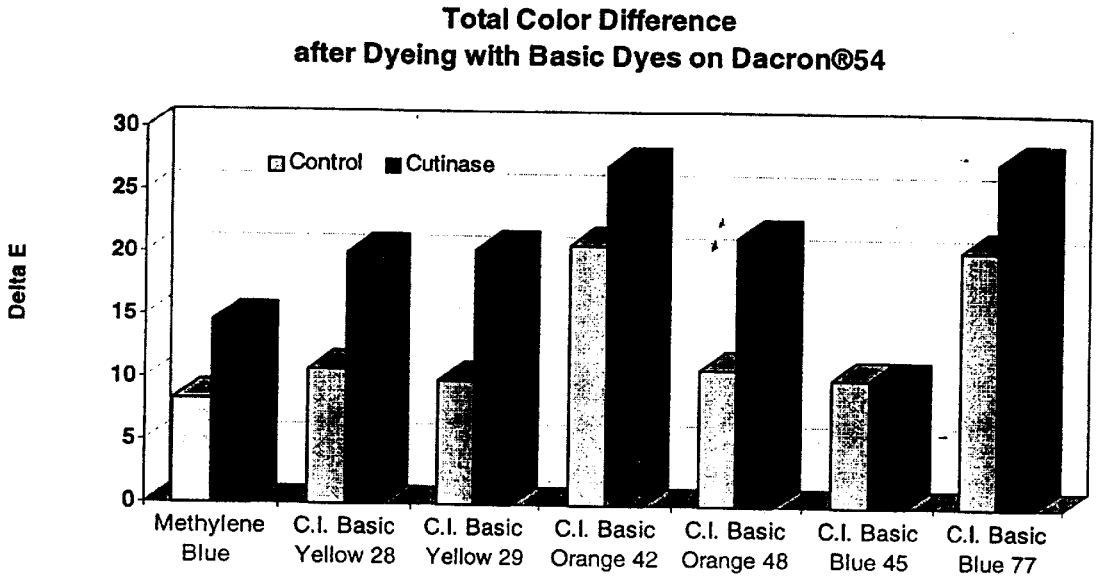
FIG. 1 illustrates the effect of polyesterase treatments on the dyeability of Dacron 54.

According to the present invention, a method is provided for modifying the surface of a polyester article comprising treating said polyester article with a polyesterase enzyme for a time and under conditions such that the chemical properties of the surface are modified to produce a surface modified polyester. Preferably, the surface modified polyester article obtained is subjected to further treatment, the benefit of which treatment has been improved by the enzymatic surface modification. In one preferred embodiment, the enzymatically surface modified polyester article is reacted with a chemical reagent to form a non-covalent interaction between the surface of the polyester and the reagent. In another preferred embodiment, the enzymatically surface modified polyester is reacted with a chemical reagent to form a covalent bond between the polyester and the reagent or another compound.

A preferred covalent interaction between the chemical reagent and the surface modified polyester of the invention comprises treating the polyester with a chemical resulting in a further increase in hydrophilic groups on the surface of the composition. Another preferred covalent interaction comprises further derivatizing chemically or enzymatically the surface of a polyester with a reagent which carries a desired functionality, for example, color or dye, antimicrobial, antiperspirant, deodorant, anti-stain or fabric finishing activity. An especially preferred covalent interaction comprises treating the surface modified polyester article with a dye to form a dye-polyester covalent bond.

A preferred non-covalent interaction between the chemical reagent and the surface modified polyester of the invention comprises treating the polyester with a dye which forms a non-covalent bond with the polyester. Other preferred non-covalent interactions comprise treating the surface of the surface modified polyester with a reagent which carries a desired functionality, for example, color or dye, anti-staining, antimicrobial, antiperspirant, deodorant or fabric finishing activity.

In a method embodiment of the invention, a method for improving the uptake of a cationic compound onto a polyester article starting material is provided comprising the steps of obtaining a polyesterase enzyme; contacting said polyesterase enzyme with the polyester article starting material under conditions and for a time suitable for the polyesterase to produce surface modification of the polyester article starting material and produce a surface modified polyester; and contacting the modified polyester article, subsequently or simultaneously with the enzymatic treatment step, with a cationic compound whereby adherence of the cationic compound to the modified polyester is increased compared to the polyester starting material. Preferably, the polyesterase is contacted with the polyester article in conjunction with a surfactant.

In a method embodiment of the invention, a polyester article is produced according to the method of the invention. Preferably, the polyester article has improved dye uptake, antimicrobial activity, resistance to stains, antiperspirant, deodorant, finishing, hydrophilicity, wettability, and/or ability to uptake other cationic compounds compared to the same polyester except for not being enzymatically treated. In a most preferred embodiment, the polyester article is dyed with a cationic dye.

"Polyester" as used herein means a linear polymeric molecule containing in-chain ester groups and which are derived from the condensation of a diacid with a diol or from the polymerization of hydroxy acids. The present invention applies to both aliphatic and aromatic polyesters. However, particularly preferred are aromatic polyester articles which are used to produce fiber and resin and that comprise a synthetically produced long chain polymer comprising at least 85%, preferably at least 90% and most preferably at least 95%, by weight of an ester of a substituted aromatic carboxylic acid, such as substituted terephthalic acid or parasubstituted hydroxybenzoate. Other useful polyester articles include those made of bulk polymer, yarns, fabrics, films, resins and powders. The principal polyesters in industrial usage include polyethylene terephthalate (PET), tetramethylene terephthalate (PTMT), polybutylene terphthalate (PBT), polytrimethylene terephthalate (PTT) and polyethylene naphthalate (PEN), polycyclohexanedimethylene terephthalate (CHDMT), poly(ethylene-4-oxybenzoate) A-Tell, polyglycolide, PHBA and 2GN. Polyester as used herein may take the form of fiber, yarn, fabric, textile article, or any other composition wherein polyester fibers, yarns or fabrics are employed.

"Polyesterase" means an enzyme that has significant capability to catalyze the hydrolysis and/or surface modification of PET. Specifically, Applicants have discovered that enzymes which have hydrolytic activity against PET under the conditions provided in the UV and MB assays provided in Example 1(a) and 1(b) (referred to herein as the "UV Assay" and the "MB Assay" respectively) are useful in the treatment of polyester resins, films, fibers, yarns and fabrics to modify the properties thereof. Accordingly, the assays provided in Example 1(a) and 1(b) may be used to isolate polyesterase enzymes and/or determine the polyesterase activity of an enzyme.

Applicants have surprisingly found that enzymes according to the present invention represent a subclass of enzymes which have significant activity against polyester and are capable of producing improved surface modification effects. By contrast, enzymes defined by prior art assays appear to be more general and to have a greater instance of false positive results. Assays designed to measure hydrolysis of mono- and di-ester units, such as the assays measuring ETE and BEB hydrolysis described in WO 99/01604, are useful in identifying a large number of enzymes, some of which may fortuitously have useful polyesterase activity. However, these assays are based on hydrolysis of mono- and di-ester molecules. As a consequence, these results are often not predictive of the likelihood that a specific enzyme will successfully modify the surface of long chain polyesters. Example 1(d) shows that assays designed on small molecule hydrolysis will broadly include enzymes which are useful against the mono- and di-ester molecules while not predicting with accuracy whether such enzymes have activity against large repeating polymer fibers such as long chain polyesters.

Thus, the polyesterase enzymes of the present invention will produce a positive result according to one or both of the polyesterase assays described herein. The activity of the enzymes of the invention in solution will produce an absorbance of at least 10% above the control blank, preferably 50% and most preferably 100% greater than the control blank. In a most preferred embodiment, the polyesterase enzymes of the invention will produce a positive result in both assays which is at least double the increase in absorbance reading of the blank sample.

Suitable polyesterases may be isolated from animal, plant, fungal and bacterial sources. With respect to the use of polyesterases derived from plants, polyesterases may exist in the pollen of many plants. Polyesterases may also be derived a fungus, such as, Absidia spp.; Acremonium spp.; Agaricus spp.; Anaeromyces spp.; Aspergillus spp., including *A. auculeatus, A. awamori, A. flavus, A. foetidus, A. fumaricus, A. fumigatus, A. nidulans, A. niger, A. oryzae, A. terreus* and *A. versicolor*; Aeurobasidium spp.; Cephalosporum spp.; Chaetomium spp.; Cladosporium spp.; Coprinus spp.; Dactyllum spp.; Fusarium spp., including *F. conglomerans, F. decemcellulare, F. javanicum, F. lini, F.oxysporum, F. roseum* and *F. solani*; Gliocladium spp.; Helminthosporum spp., including *sativum*; Humicola spp., including *H. insolens* and *H. lanuginosa*; Mucor spp.; Neurospora spp., including *N. crassa* and *N. sitophila*; Neocallimastix spp.; Orpinomyces spp.; Penicillium spp; Phanerochaete spp.; Phlebia spp.; Piromyces spp.; Pseudomonas spp.; Rhizopus spp.; Schizophyllum spp.; Trametes spp.; Trichoderma spp., including *T. reesei, T. reesei* (*longibrachiatum*) and *T. viride*; and Ulocladium spp., including *U. consortiale*; Zygorhynchus spp. Similarly, it is envisioned that a polyesterase may be found in bacteria such as Bacillus spp.; Cellulomonas spp.; Clostridium spp.; Myceliophthora spp.; Pseudomonas spp., including *P. mendocina* and *P. putida*; Thermomonospora spp.; Thermomyces spp., including *T. lanuginosa*; Streptomyces spp., including *S. olivochromogenes* and *S. scabies*; and in fiber degrading ruminal bacteria such as *Fibrobacter succinogenes*; and in yeast including Candida spp., including *C. Antarctica, C. rugosa, torresii; C. parapsllosis; C. sake; C. zeylanoides; Pichia minuta; Rhodotorula glutinis; R. mucilaginosa*; and *Sporobolomyces holsaticus.*

"Textile" means any fabric or yarn or product which incorporates a fabric or yarn. Examples of textiles which may be treated with the present invention include clothing, footwear, upholstery, draperies, carpets, outdoor gear, ropes and rope based products. As used in the present invention, textile includes non-woven fabrics used in, for example, the medical industry.

In one embodiment, chemical compounds are reacted with the surface of the enzymatically treated polyester. In one preferred embodiment, the chemical compounds are selected such that they form a covalent bond with the surface modified polyester and further increase the presence of hydrophilic groups on the surface of the polyester. Surface modification with polyesterase is believed to produce a profusion of new, exposed alcohol and carboxylate groups. According to the present invention, these groups are then susceptible to chemical or enzymatic derivatization with chemicals that are capable of further increasing the hydrophilicity and/or charge of the surface. Such compositions include organic acids such as acetate, carboxylate and succinate. Alternatively, the derivitized polyester will have an improved capability of reacting with chemicals which react with carboxylic acids and/or alcohols, thus providing the opportunity to produce additional effects in the polyester. Acid anhydrides are one such set of chemicals.

"Uptake" means, with respect to uptake onto polyester article as provided herein, the process of covalently or non-covalently binding a compound to the surface modified polyester article to obtain a specific effect, e.g., softening, dyeing, anti-static, anti-staining, antimicrobial, antiperspirant, deodorant or otherwise modifying the properties of the polyester fiber or fabric. As provided herein, the surface modified polyesters of the invention provide a superior substrate from which to add further benefits. Accordingly, the surface modified polyester compounds of the invention will permit, for example, improved dye binding to polyester over a similar polyester which differs only in that it has not been enzymatically treated. As used herein, covalent binding means that a molecular bond is formed between the uptake composition and the fiber, yarn or fabric. To the contrary, non-covalent binding means that the composition to be taken up is adhered to the fiber, yarn or fabric through mechanisms such as hydrogen bonding, van der Waals binding or other molecular interactions that do not comprise the formation of a molecular bond connecting the uptake composition and the fiber, yarn or fabric.

In a particularly preferred embodiment, the compound covalently or non-covalently bound to the surface comprises a "cationic compound." As used herein, cationic compound means any compound which has a cationic character and which adds a desirable attribute when bound to a polyester. Suitable cationic compounds for use with the present invention include:

Antimicrobial compounds such as cationic antimicrobial peptides and quaternary ammonium salts;

Surfactants having a cationic nature;

Fragrances;

Fabric softeners;

Dyes and pigments such as the cationic basic dyes listed in Analytical Methods for a Textile Laboratory, 3rd Edition, Ed. J. W. Weaver;

Fabric finishing;

Wetting agents

Biofunctional molecules which have medicinal effect in polyester medical implants or devices.

"Fabric finishing compounds" or "fabric finishes" means compounds which improve the textile properties of a polyester fabric or yarn. Examples are compound which improve the softness, flame retardance, wrinkle resistance, absorbency, stain resistance, resistance to microorganisms or insects, resistance to ultraviolet light, heat and pollutants, shrink-proofing, abrasion and wear resistance, resistance to pilling, drape, insulating properties, pleat retention and/or static resistance of polyester fabrics (see e.g., Textile Processing and Properties, Tyrone Vigo, Elsevier Science B.V. (1994)).

"Treatment" means with respect to treatment with polyesterase the process of applying the polyesterase to polyester article such that the enzyme is capable of reacting with the surface of the polyester article to increase the hydrophilicity thereof to such an extent that adherence of cationic compounds is significantly improved. Generally, this means that the polyesterase is mixed with the polyester article in an aqueous environment that facilitates the enzymatic action of the polyesterase.

Treating according to the instant invention comprises preparing an aqueous solution that contains an effective amount of a polyesterase or a combination of polyesterases together with other optional ingredients including, for example, a buffer or a surfactant. An effective amount of a polyesterase enzyme composition is a concentration of polyesterase enzyme sufficient for its intended purpose. Thus, for example, an "effective amount" of polyesterase in a composition intended to improve dye uptake according to the present invention is that amount which will provide the desired effect, e.g., to improve the appearance of the dyed article in comparison with a similar method not using polyesterase. Similarly, an "effective amount" of polyesterase in a composition intended for improving the softness of a polyester fabric is the amount that, in combination with a fabric softening compound, produces measurable improvements in the softness compared to a similar process without the polyesterase. The amount of polyesterase employed is also dependent on the equipment employed, the process parameters employed, e.g., the temperature of the polyesterase treatment solution, the exposure time to the polyesterase solution, and the polyesterase activity (e.g., a particular solution will require a lower concentration of polyesterase where a more active polyesterase composition is used as compared to a less active polyesterase composition). The exact concentration of polyesterase in the aqueous treatment solution to which the fabric to be treated is added can be readily determined by the skilled artisan based on the above factors as well as the desired result. However, it has been observed by the inventors herein that the benefit disclosed herein requires a relatively rigorous polyesterase treatment. Thus, the benefits described herein are not likely to be shown with modest concentrations of polyesterase and relatively short (less than one hour) treatment times. Nonetheless, it is possible that an engineered polyesterase or a polyesterase with exceptionally high activity on polyester could be obtained which would require less than 1 hour of treatment to reach the desired benefit levels and thus fall within the scope of the present invention. Similarly, employing large amounts of polyesterase for short periods of time may also result in achievement of the benefits described herein.

In a preferred treating embodiment, a buffer is employed in the treating composition such that the concentration of buffer is sufficient to maintain the pH of the solution within the range wherein the employed polyesterase exhibits the desired activity. The pH at which the polyesterase exhibits activity depends on the nature of the polyesterase employed. The exact concentration of buffer employed will depend on several factors which the skilled artisan can readily take into account. For example, in a preferred embodiment, the buffer as well as the buffer concentration are selected so as to maintain the pH of the final polyesterase solution within the pH range required for optimal polyesterase activity. The determination of the optimal pH range of the polyesterase of the invention can be ascertained according to well known techniques. Suitable buffers at pH within the activity range of the polyesterase are also well known to those skilled in the art in the field.

In addition to polyesterase and a buffer, the treating composition will preferably contain a surfactant. Suitable surfactants include any surfactant compatible with the polyesterase being utilized and the fabric including, for example, anionic, non-ionic and ampholytic surfactants. Suitable anionic surfactants include, but are not limited to, linear or branched alkylbenzenesulfonates; alkyl or alkenyl ether sulfates having linear or branched alkyl groups or alkenyl groups; alkyl or alkenyl sulfates; olefinsulfonates; alkanesulfonates and the like. Suitable counter ions for anionic surfactants include, but are not limited to; alkali metal ions such as sodium and potassium; alkaline earth metal ions such as calcium and magnesium; ammonium ion; and alkanolamines having 1 to 3 alkanol groups of carbon number 2 or 3. Ampholytic surfactants include, e.g., quaternary ammonium salt sulfonates, and betaine-type ampholytic surfactants. Such ampholytic surfactants have both the positive and negative charged groups in the same molecule. Nonionic surfactants generally comprise polyoxyalkylene ethers, as well as higher fatty acid alkanolamides or alkylene oxide adduct thereof, and fatty acid glycerine monoesters. Mixtures of surfactants can also be employed in manners known to those skilled in the art.

In a particularly preferred embodiment of the invention, it is desirable to add glycerol, ethylene glycol or polypropylene glycol to the treating composition. Applicants have discovered that the addition of glycerol, ethylene glycol, or polypropylene glycol contributes to enhanced activity of the polyesterase on polyester. Applicants have determined that defoaming and/or lubricating agents such as Mazu® have a desirable effect on the activity of the polyesterase.

In some embodiments, it may be desirable to adjust the parameters discussed above for the purpose of controlling the enzymatic degradation. For example, the pH can be adjusted at certain time points to extinguish the activity of the polyesterase and prevent undesirable excessive degradation. Alternatively, other art recognized methods of extinguishing enzyme activity may be implemented, e.g., protease treatment and/or heat treatment.

As can be seen above, the present invention is useful in the preparation of laundry detergents. For example, it may be desirable to encourage the uptake of a cationic laundry adjuvant, i.e., a fabric softener or other such compounds which improve the feel, appearance or comfort of laundered fabrics. In this case, the present invention will provide for methods to modify the polyester during the wash cycle so as to encourage the uptake of the advantageous adjuvant.

EXAMPLES

Example 1

This Example provides for two assays which identify polyesterase activity in a potential enzyme candidate. Preferably, the enzyme will show polyester hydrolysis activity in both assays.

(A) Assay for Enzymatic Hydrolysis of Long Chain Polyester Polymer Fibers Based on Ultraviolet Light Absorbance (UV Assay)

This assay monitors the release of terephthalate and its esters resulting from the enzymatic hydrolysis of polyester and measures the hydrolysis product by subjecting the sample to the UV spectrum and measuring absorbance.

Materials:

Enzyme reaction buffer: 100 mM Tris, pH 8, optionally containing 0.1% Brij®-35

Procedure:

1. The polyester is washed with hot water and air dried. Applicants recommend and exemplify herein the use of such easily obtained standardized polyesters as Dacron® 54 woven polyester (from Testfabrics)(used in the description below). However, it will often be preferable to use the specific polyester substrate for which modification is desired, e.g., fabric, powder, resin or film, thereby ensuring that the enzyme selected will have optimal activity on that specific substrate. In such case, it is merely necessary to substitute the desired polyester substrate for the below described Dacron.
2. ⅝-inch circular swatches are cut from the Dacron® 54.
3. The swatches are incubated in reaction buffer in sealed 12-well microtiter plates with orbital shaking at 250 rpm. A typical reaction is 1 mL in volume, with 10 $\mu$g enzyme. Three samples should be run: (1) substrate+buffer, (2) enzyme+buffer, (3) enzyme+substrate+buffer.
4. The reaction is allowed to proceed for 18 hours at 40° C.
5. Terephthalate and its esters have characteristic strong absorbance peaks around 240–244 nm ($\epsilon_M$~10,000). Therefore, if these species are released to the liquid phase of the reaction by enzymatic hydrolysis, the absorbance of liquid phase of the reaction will be increased at these wavelengths.
6. To determine if hydrolysis has occurred, one determines the absorbance of the liquid phase of the enzyme+substrate+buffer reaction at around 240–250 nm. The appropriate blanks (substrate+buffer, and enzyme+buffer) must be subtracted. These measurements can be carried out in a quartz cuvette in a spectrophotometer or a UV-transparent microtiter plate in a microplate reader capable of the required wavelengths.
7. To confirm that the absorbance readings higher than the blanks are actually due to terephthalate compounds, an absorbance spectrum of the reaction mixture should be scanned from 220–300 nm. Only a peak around 240–244 nm should be considered as actual reaction product.
8. Terephthalic acid and diethyl terephthalate are commercially available. Their absorbance spectra should serve as standards.

(B) Assay for Enzymatic Hydrolysis of Long Chain Polyester Polymer Fibers Based on Binding of Methylene Blue (MB Assay)

This assay utilizes the binding of methylene blue, a cationic dye, to the free carboxylate groups generated by hydrolysis of polyester.

Materials:

Enzyme reaction buffer: 100 mM Tris, pH 8, containing 0.1% Triton® X-100

Wash buffer: 100 mM MES, pH 6.0

Dye solution: 0.1 mg/mL methylene blue in 1 mM MES, pH 6.0

Dye elution buffer: 0.5 M NaCl in 10 mM MES, pH 6.0

Dacron 54 woven polyester from Testfabrics.

Procedure:

1. The polyester is washed with hot water and air dried. Applicants recommend the use of such easily obtained standardized polyesters as Dacron® 54 woven polyester (from Testfabrics) (used in the description below). However, it will often be preferable to use the specific polyester substrate for which modification is desired, e.g., fabric, powder, resin or film, thereby ensuring that the enzyme selected will have optimal activity on that specific substrate.
2. ⅝-in. circular swatches are cut from the Dacron®.
3. The swatches are incubated in reaction buffer in sealed 12-well microtiter plates with orbital shaking at 250 rpm. A typical reaction is 1 mL in volume, with 10 μg enzyme. Blanks (samples with no enzyme) should be run as well.
4. The reaction is allowed to proceed for 18 hours at 40° C.
5. The reaction solution is removed by suction, and the swatches are subsequently washed with: (1) 1 ml incubation buffer, to deplete residual enzyme; (2) 1 ml water, to deplete the incubation buffer; (3) 1 ml 100 mM MES buffer, to equilibrate the swatches to pH 6; and (4) 1 ml water again, deplete the MES buffer.
6. 1 mL of dye solution is added to each well, and the plate is shaken at 250 rpm for 20 min at 40° C. In this case, methylene blue is used. However, other cationic dyes or "reporter" reagents can be used as well. Hydrolysis by 100 mM NaOH can be used as a positive control.
7. The excess dye (methylene blue) is removed by suction, and the wells are washed 3 times with 1 ml water.
8. 1 mL dye elution buffer is added to each well, and the plate is shaken at 250 rpm for 30 min at 40° C.
9. 300 μL of the dye eluate is transferred from each well to a 96-well plate, and the absorbance peak at 650 nm is determined.

In either of the above assays described in Examples 1(a) and 1(b), the absorbance reading should show significant hydrolytic product which is not attributable to experimental error or non-hydrolytic effects. One of skill in the art is well aware of these effects and how to guard against them in interpreting results.

(C) Assay for Enzymatic Hydrolysis of the Diethyl Terephthalate (DET)

This spectrophotometric assay monitors the change in the UV spectrum of DET which accompanies its hydrolysis.

DET has a characteristic absorbance peak around 244 nm $\epsilon_M$~10,000). The ester hydrolysis products have a lower absorbance, and the peak is shifted to 240 nm. Consequently, the hydrolysis of DET can be monitored by measuring the decrease in absorbance at 250 nm.

Reagents:

Enzyme reaction buffer: 10 mM Tris, pH 8

DET stock solution: 100 mM in DMSO

Procedure:

1. Dilute DET 1000-fold into reaction buffer to yield a 100 pM solution. Place in a cuvette or UV transparent microtiter plate.
2. Set the spectrophotometer wavelength at 250 nm.
3. Add enzyme, and monitor the change in absorbance. In a separate sample of the same volume of buffer without enzyme, determine the absorbance change resulting from background hydrolysis.
4. Reaction rate is calculated from the linear portion of the reaction progress curve and reported as −mAU/min and the reaction rate of the buffer blank is subtracted.

(D) Comparison of Results of PET and DET Assays

Enzymes having esterase and/or lipase activity were obtained from numerous sources and tested according to the assays described in Examples 1(a), 1(b) and 1(c). The relative results are tabulated in Table I with the hydrolysis product absorbance of *P. mendocina* cutinase being calculated as 1.0.

TABLE I

| Origin | Enzyme Class | DET | PET (UV) | PET (MB) |
|---|---|---|---|---|
| Blank/Control | | <0.3 | <0.1 | <0.4 |
| *Pseudomonas mendocina* | Cutinase | 1.0 | 1.0 | 1.0 |
| Pseudomonas sp | Lipase | 1.2 | 0.2 | <0.4 |
| *Pseudomonas fluorescens* | Lipase | <0.3 | 0.1 | <0.4 |
| *Aspergillus niger* | Esterase | 0.8 | <0.1 | <0.4 |
| *Candida antarctica* | Lipase A | <0.3 | <0.1 | <0.4 |
| *Candida antarctica* | Lipase B | 2.3 | <0.1 | <0.4 |
| *Candida lipolytica* | Lipase | 0.1 | <0.1 | <0.4 |
| *Candida rugosa* | Lipase | 0.8 | <0.1 | 0.5 |
| *Candida rugosa* | Lipase, purif. | 2.2 | <0.1 | <0.4 |
| *Humicola lanuginosa* | Lipase | 0.3 | <0.1 | <0.4 |
| *Rhizopus delmar* | Lipase | 0.7 | <0.1 | <0.4 |
| *Rhizopus javanicus* | Lipase | 0.7 | <0.1 | <0.4 |
| *Rhizopus niveus* | Lipase | 0.8 | <0.1 | <0.4 |
| *Mucor meihei* | Lipase | <0.3 | <0.1 | <0.4 |
| Wheat Germ | Lipase | 0.6 | <0.1 | <0.4 |
| Lipolase ™[1] | Lipase | 1.2 | <0.1 | <0.4 |
| Lipomax ™[2] | Lipase | 2.7 | <0.1 | 0.7 |
| Pig Pancreas | Lipase | 1.0 | <0.1 | <0.4 |
| Pig Liver[3] | Esterase I | 3.1 | <0.1 | <0.4 |
| Pig Liver | Esterase II | 2.0 | <0.1 | <0.4 |
| E001[4] | Esterase | 2.3 | <0.1 | <0.4 |
| E002 | Esterase | 3.3 | <0.1 | <0.4 |
| E003 | Esterase | 5.0 | <0.1 | <0.4 |
| E004 | Esterase | 1.2 | <0.1 | <0.4 |
| E005 | Esterase | 1.3 | <0.1 | <0.4 |
| E006 | Esterase | 2.7 | <0.1 | <0.4 |
| E007 | Esterase | 2.4 | <0.1 | <0.4 |
| E008 | Esterase | 2.0 | <0.1 | <0.4 |
| E009 | Esterase | 1.5 | <0.1 | <0.4 |
| E010 | Esterase | 2.6 | <0.1 | <0.4 |
| E011 | Esterase | 4.0 | 0.1 | <0.4 |
| E012 | Esterase | 1.1 | <0.1 | <0.4 |
| E013 | Esterase | 2.4 | <0.1 | <0.4 |
| E014 | Esterase | 5.2 | <0.1 | <0.4 |
| E015 | Esterase | 3.6 | <0.1 | <0.4 |
| E016 | Esterase | 2.0 | <0.1 | <0.4 |
| E017b | Esterase | 3.7 | <0.1 | <0.4 |
| E018b | Esterase | 0.6 | <0.1 | <0.4 |
| E019 | Esterase | 0.9 | <0.1 | <0.4 |
| E020 | Esterase | 2.0 | <0.1 | <0.4 |
| ESL-001-01[5] | Esterase | 0.7 | <0.1 | <0.4 |
| ESL 001-02 | Esterase | 4.6 | <0.1 | <0.4 |
| ESL-001-03 | Esterase | 0.6 | <0.1 | <0.4 |
| ESL 001-04 | Esterase | 1.3 | <0.1 | <0.4 |
| ESL 001-05 | Esterase | 0.9 | <0.1 | <0.4 |
| ESL 001-06 | Esterase | 0.4 | <0.1 | <0.4 |
| ESL 001-07 | Esterase | 0.9 | <0.1 | <0.4 |
| Chiro-CLEC-CR[6] | EC 3.1.1.3 | 0.5 | <0.1 | <0.4 |

TABLE I-continued

| Origin | Enzyme Class | DET | PET (UV) | PET (MB) |
|---|---|---|---|---|
| Chiro-CLEC-BL | EC 3.4.21.14 | <0.3 | <0.1 | <0.4 |
| Chiro-CLEC-PC | EC 3.1.1.3 | 0.8 | 0.1 | <0.4 |
| Chiro-CLEC-EC | EC 3.5.1.11 | 0.7 | <0.1 | <0.4 |

[1](commercial product obtained from Novo Nordisk)
[2](commercial product obtained from Genencor International, Inc.)
[3](Pig Liver Esterase I and II obtained from Boehringer Mannheim Chira-Zyme ™ Lipases & Esterases Screening Set (Germany))
[4](All E series esterases listed were obtained from the ThermoCat ™ R&D product line from Thermogen (Chicago, IL))
[5](All "ESL" series esterases were obtained from Diversa Esterase/Lipase CloneZyme ™ Library)
[6](All ChiroCLEC ™ enzymes obtained from Altus Corp ChiroScreen ™ Enzyme Set (Cambridge, Massachusetts))

As can be seen from the above, nearly all of the enzymes tested have activity in the DET assay (di-esterase activity). However, only one of the tested enzymes has significant activity in both of the PET assays. From this evidence, it is apparent that, while there is cross over in terms of enzymes which have activity in the DET assay and also have PET hydrolytic activity, there are a great number of enzymes which do have DET hydrolytic activity but do not have polyesterase activity. As shown in Examples 2 and 3, the enzyme with PET activity provides significant enzymatic conversion of the polyester fibers. From this data, Applicants determined that the identity of an enzyme having polyesterase activity cannot be predicted from whether that enzyme has mono- or di-esterase activity.

Example 2

Enzymatic Surface Modification of Polyester Fibers With Polyesterase To Modify the Functional Surface Properties of the Polyester Equipment: Launder-Ometer Treatment pH: pH 8.6 (50 mM Tris Buffer)

Treatment temperature: 40° C.

Treatment time: 24 hours

Enzyme: Cutinase from *Pseudomonas mendocina*@40 ppm

Control: Inactivated cutinase (*Pseudomonas mendocina*) @40 ppm

Substrates: 100% Polyester
Dacron® 54 (style number 777 from TestFabrics)
Dacron® 64 (style number 763 from TestFabrics)

To ensure that all observed effects were due solely to the modification of the polyester surface, and not from adhered protein effects, the swatches were treated with protease. After the polyesterase treatments, ⅝ inch disks were cut from the treated swatches. Then the disks were incubated with 5 ppm subtilisin and 0.1% non-ionic surfactant (Triton X-100) to remove proteins bound onto polyester. The levels of bound proteins were examined using coomassie blue staining to ensure that minimal protein remained bound to the fabric.

After enzyme treatment followed by protease/surfactant treatments, the disks were dyed in 12 well microtiter plate under the following conditions:

Liquor ratio: 40 to 1

Dye concentration: 0.4% owf

Temperature: 40° C.

pH: 6 (lmM MES buffer at pH 6.0)

Time: 20 minutes

Agitation of shaker: 200 rpm

The disks were rinsed three times with Dl water after dyeing, air dried, and then measured for CIE L*a*b* values using a reflectometer. The total color difference was calculated using the following formula:

$$\text{Delta } E = \text{Square Root } (\Delta L^{*2} + \Delta a^{*2} + \Delta b^{*2})$$

ΔL=Difference in CIE L* values before and after dyeing

Δa=Difference in CIE a* values before and after dyeing

Δb=Difference in CIE b* values before and after dyeing (These terms are defined in, for example, Duff & Sinclair, Giles's Laboratory Course in Dyeing, 4th Edition, Society of Dyers and Colourists).

TABLE 1

Total Color Difference after Dyeing with Different Basic Dyes

| Basic Dyes | | Total Color Difference (ΔE) | | | |
|---|---|---|---|---|---|
| | | Dacron 54 | | Dacron 64 | |
| Dye classes | | Control | Cutinase | Control | Cutinase |
| Methylene Blue | | 8.37 | 14.66 | 20.28 | 25.10 |
| C.I. Basic Yellow 28 | (Monazo) | 10.72 | 20.05 | 26.32 | 32.09 |
| C.I. Basic Yellow 29 | (Methine) | 9.99 | 20.35 | 28.17 | 34.92 |
| C.I. Basic Orange 42 | (Azo-methine-azo) | 20.75 | 27.15 | 33.04 | 39.81 |
| C.I. Basic Orange 48 | (Azo) | 10.92 | 21.41 | 20.30 | 26.15 |
| C.I. Basic Blue 45 | (Anthraquinone) | 10.18 | 10.27 | 17.06 | 21.21 |
| C.I. Basic Blue 77 | (Triarylmethane) | 20.53 | 27.59 | 28.81 | 40.89 |

Figure 2:
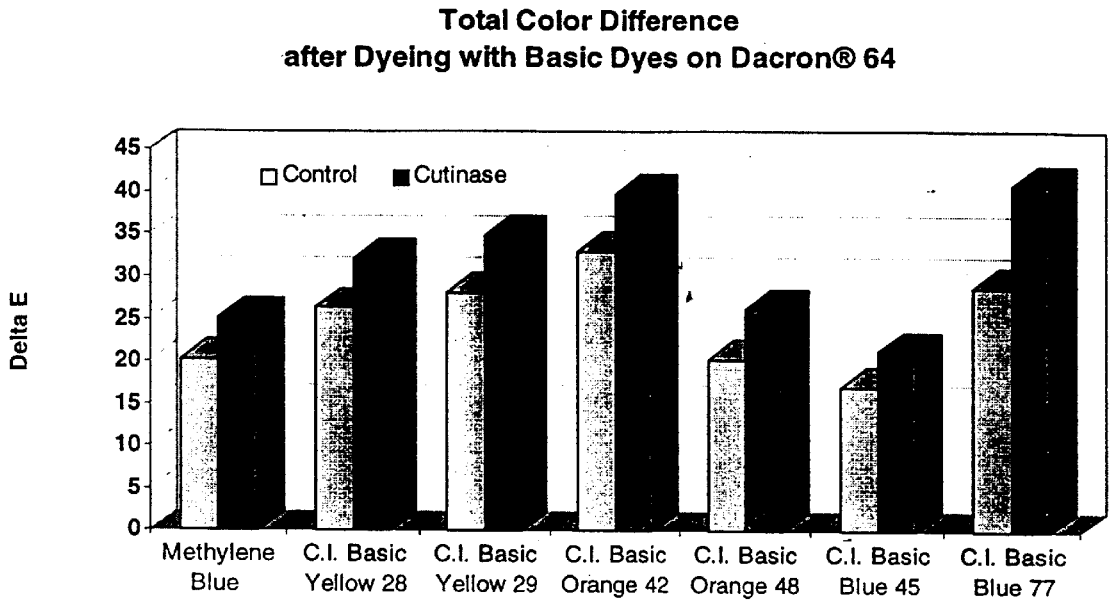
FIG. 2 illustrates the effect of polyesterase treatments on the dyeability of Dacron 64.

The results are compiled graphically in FIGS. 1 and 2. As can be seen, polyesterase significantly effects the ability of the polyester fabrics to take up and adhere a range of cationic dyes.

What is claimed is:

1. A method for modifying the surface of a polyester article comprising the steps of: (a) treating said polyester article with an enzyme having hydrolytic activity on polyester as measured by either the UV Assay or the MB Assay for a time and under conditions such that the ability to uptake compounds to the surface of said polyester article is improved, and (b) contacting said treated polyester with a compound under conditions suitable to adhere said compound to said polyester.

2. The method according to claim 1, wherein said compound forms a covalent bond and is capable of increasing the hydrophilicity and/or charge of the surface of the polyester.

3. The method of claim 2, wherein said compound is capable of reacting with an alcohol and/or a carboxylic acid.

4. The method according to claim 2, wherein said compound comprises a fabric finishing compound, dye, anti-static compound, anti-staining compound, antimicrobial compound, antiperspirant compound and/or a deodorant compound.

5. A method for improving the uptake of a cationic compound onto a polyester article starting material, comprising the steps of:

(a) obtaining an enzyme having hydrolytic activity on polyester as measured by either the UV Assay or the MB Assay;

(b) contacting said enzyme having hydrolytic activity on polyester as measured by either the UV Assay or the MB Assay with said polyester article starting material under conditions and for a time suitable for said enzyme to produce surface modification of said polyester article starting material and produce a surface modified polyester;

(c) contacting said modified polyester article, subsequently or simultaneously with said step (b) with a cationic compound whereby adherence of said cationic compound to said modified polyester is increased compared to said polyester starting material.

6. The method of claim 5, wherein said surface modified polyester is contacted with a cationic compound simultaneously with said step (b).

7. The method of claim 5, wherein said surface modified polyester is contacted with a cationic compound subsequent to said step (b).

8. The method of claim 5, wherein said cationic compound comprises a fabric finishing compound, dye, antistatic compound, anti-staining compound, antimicrobial compound, antiperspirant compound and/or a deodorant compound.

9. The method of claim 5, wherein said cationic compound comprises a dye.

10. The method of claim 9, where said dye is a basic dye.

11. The method according to claim 5, wherein said cationic compound comprises a fabric finishing compound.

12. The method according to claim 5 wherein said enzyme is derived from Absidia spp.; Acremonium spp.; Agaricus spp.; Anaeromyces spp.; Aspergillus spp; Aeurobasidium spp.; Cephalosporum spp.; Chaetomium spp.; Coprinus spp.; Dactyllum spp.; Fusarium spp.; Gliocladium spp.; Humicola spp., including *H. insolens* and *H. lanuginosa*; Mucor spp.; Neurospora spp.; Neocallimastix spp.; Orpinomyces spp.; Penicillium spp; Phanerochaete spp.; Phlebia spp.; Piromyces spp.; Pseudomonas spp.; Rhizopus spp.; Schizophyllum spp.; Trametes spp.; Trichoderrna spp.; Zygorhynchus spp.; Bacillus spp.; Cellulomonas spp.; Clostridium spp.; Myceliophthora spp.; Thermomonospora spp.; Streptomyces spp.; Fibrobacter spp.; Candida spp.; *Pichia minuta, Rhodotorula glutinis; R. mucilaginosa; Sporobolomyces holsaticus*; or Thermomyces spp.

13. A polyester article produced according to the method of claim 1.

14. The polyester article according to claim 13, wherein said composition has an increased resistance to stains.

15. The polyester article according to claim 13, wherein subsequent to said treating, said article is dyed with a cationic dye.

* * * * *